United States Patent [19]

Rose

[11] Patent Number: 4,983,089

[45] Date of Patent: Jan. 8, 1991

[54] MOBILE SILO

[76] Inventor: Ernst D. Rose, Rue Pascal 1245-A, Campo Bello, 04616 Sao Paulo City, Brazil

[21] Appl. No.: 456,893

[22] Filed: Dec. 26, 1989

[51] Int. Cl.[5] ..... B65G 1/00; B65G 65/00

[52] U.S. Cl. ..... 414/276; 414/299; 414/919; 414/267; 52/79.2; 52/79.3; 52/79.5; 52/196; 52/234; 220/1.5; 220/22; 312/107

[58] Field of Search ..... 206/509; 220/1.5, 22; 410/68; 414/12, 143.2, 267, 276, 288, 293, 298, 299, 331, 919; 52/79.1, 79.2, 79.3, 79.4, 127.2, 127.6, 127.8, 192, 196, 234, 236.3, 236.4; 312/107, 108

[56] References Cited

U.S. PATENT DOCUMENTS

| | | | |
|---|---|---|---|
| 867,962 | 10/1907 | Finton | 414/267 |
| 2,013,284 | 9/1935 | Michaud | 312/107 |
| 2,678,737 | 5/1954 | Mangrum | 414/919 X |
| 2,871,080 | 1/1959 | Shelly | 312/107 |
| 3,753,507 | 8/1973 | James et al. | 414/276 |
| 4,098,424 | 7/1978 | Liebscher et al. | 220/1.5 X |
| 4,221,515 | 9/1980 | Brown et al. | 220/1.5 X |
| 4,362,453 | 12/1982 | Driedger | 52/79.3 X |
| 4,717,214 | 1/1988 | Moore et al. | 312/107 |
| 4,854,094 | 8/1989 | Clark | 52/234 X |

*Primary Examiner*—Robert J. Spar
*Assistant Examiner*—Craig A. Slavin
*Attorney, Agent, or Firm*—Malloy, Downey & Malloy

[57] ABSTRACT

A mobile grain silo for the transportation and storage of grain, granulated food and other such materials, wherein the mobile grain silo includes individual storage cells of a generally parallelogram shape constructed around a frame structure and having means for lifting on and off a mobile transport and for interconnecting the cells in stacked relation to one another. The individual storage cells having a loading door for filling and an exit door for discharging the contents therein and further having a viewing port to inspect the interior of the cell.

15 Claims, 5 Drawing Sheets

MOBILE SILO

BACKGROUND OF THE INVENTION

1. Field of the Invention

The present invention is directed to a mobile silo for the storage and transport of grain including but not limited to pelletized or granulated food substances wherein the mobile silo includes individual storage cells which function as a complete individual silo and can be transported by truck, railroad, ship, or any suitable means of transportation from port terminals to rural areas such as farms, manufacturing plants and the like.

2. Description of the Prior Art

The use of grain silos for the storage, loading and discharging of grain has been well known for many years throughout the United States and many other nations of the world. In transporting grain to and from these silos, it is necessary to drive a truck underneath a discharge shoot whereby grain is then emptied from the silo into the truck through gravitational force. These trucks loaded with the grain are then driven to their destination where the grain is then dumped into a storage bin or like facility where it is then consumed as needed.

Often it is necessary to load a granulated food substance into separate bags to protect it during transport from the silo to its final destination. In doing so, a great deal of time is required to discharge the grain from the silo into the separate bags. Further, a considerable amount of grain is wasted because of spill-over when loading the individual bags.

Another problem associated with the silos known in the prior art is the loss of germinative qualities due to grain being subjected to high pressures when stored in grain columns of a substantial height. Further, it is a common occurrence in many of the presently existing grain silos for a cereal or food substance of better quality to become mixed in similar grains of a lower grade when storing and shipping the grains in a bulk shipment.

Accordingly, the present invention is specifically designed to overcome the above-referenced problems through the use of individual storage cells of limited size which can be easily transported and stacked one upon the other at a central location. The grain which is to be shipped is loaded into each individual storage cell at a central location whereupon the storage cell is then lifted from its stacked position and individually loaded on to a truck for transport to its final destination. Upon arriving at its destination, the individual storage cells can be unloaded from the truck where it will then be used as an individual silo for the storage and discharge of the grain as needed.

SUMMARY OF THE INVENTION

The present invention is directed towards a mobile silo for the storage and transportation of grain, granulated or pelletized food substances and other related material. An important feature of the present invention consists of an individual storage cell which can easily be transported by means of a truck or train and which functions as an independent grain silo for use at its final destination.

The individual storage cells of the present invention include a frame structure constructed from interconnected stanchions wherein the frame structure defines the outer configuration of the storage cells. When viewed from the side, the frame structure has the general appearance of a parallelogram having a top and bottom being parallel to one another and two parallel ends extending between the top and bottom at a 60° angle thereto. The storage cell further includes retaining walls connected to and extending between the frame structure and acting to define an interior storage compartment within the cell structure.

In order to facilitate stacking of the storage cells, locking means are provided on the frame structure and are especially adapted for facilitating lifting of the storage cell to and from a transport vehicle whereupon the cells can be stacked upon one another in interlocking engagement.

In normal operation, the individual storage cells can be stacked one upon the other at a central loading locating where each of the storage cells can be independently filled with the required shipment of grain. Subsequently, when the load of grain is to be shipped, the individual storage cell containing the grain can be lifted from its seated position in the stack of cells at the loading location and thereupon placed on a transport vehicle where it can easily and efficiently be shipped to its point of destination. Commonly, the point of destination is a farm or ranch located in a rural area lacking any sophisticated storage facilities. Accordingly, these individual mobile storage cells can be used as an independent grain silo on a farm or ranch whereupon they can be seated on a cradle structure and the grain discharged therefrom as necessary.

In order to facilitate the filling and discharging of grain from within an individual storage cell, there is provided a loading door and discharge door located on opposite ends of the storage cell. Additionally, there is a viewing port located on the top wall of the storage cell to allow a person to inspect the contents within the storage compartment of the cell.

When the contents of the individual storage cells are completely emptied, the cell can be easily transported back to the loading port whereupon a subsequent shipment of grain or like material can be refilled into the cell and returned to its appropriate location. Obviously, such a system reduces the amount of waste normally encountered during filling and discharging grain from a central silo onto a dump truck or like vehicle. Furthermore, the mobile individual storage cells facilitate not only the transportation of cargo to and from the central loading port, but also the storage and discharge of an individual load of grain at its destination point.

The invention accordingly comprises the features of construction, combination of elements and arrangement of parts which should be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

DETAILED DESCRIPTION OF THE PREFERRED EMBODIMENT

Figure 1:
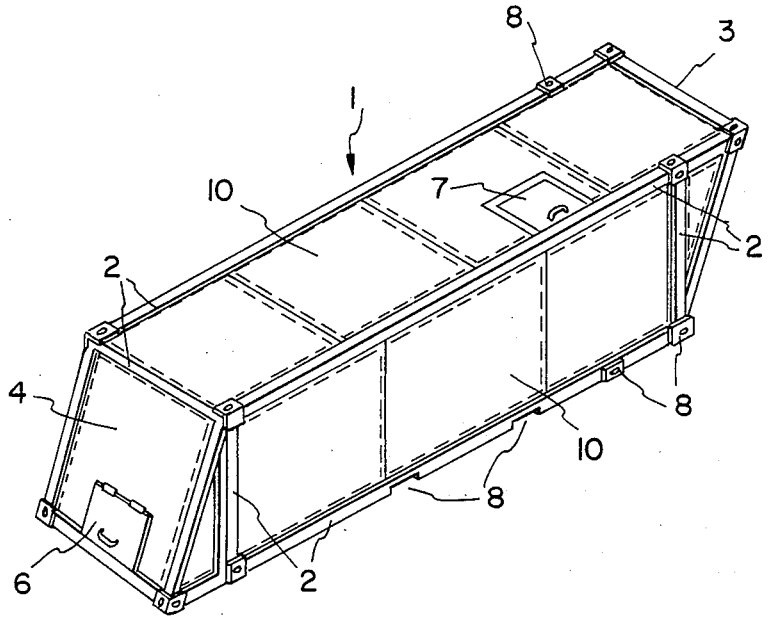
FIG. 1 is a perspective view of an individual cell of what is considered the basic unit of the mobile silo.

Referring to FIG. 1, the preferred embodiment of the present invention includes an individual storage cell 1 having the general appearance of an elongated container viewed from the side as a parallelogram form. Its front end 4 and back end 3 have a square or slightly rectangular form.

The outer configuration of the container is defined by a structural frame 2 which includes individually interconnected stanchions as at 3. The storage cell 1 further includes retaining walls 10 which are connected to and extend between the stanchions of the frame structure 2. The retaining walls are generally made of metal plates that can be smooth, corrugated or otherwise shaped for the desired function. The corners and certain designated points along the structural frame include interlocking means 8 which are specifically designed to facilitate lifting of the storage cells to and from a transport vehicle as well as being adapted for interlocking connection with other such storage cells. The interlocking means 8 further acts to add to the structural integrity of the storage cell by adding reinforced material to the frame structure. The front end 4 and back end 3 are generally parallel to one another and inclined at an angle of 60° in relation to the top wall and bottom wall. In this manner, the individual storage cell can be stacked in an inclined position to facilitate gravitational flow of the grain through the storage compartment and out of an exit means 6 with the front end wall 4 and back end wall 3 being generally perpendicular to the underlying ground surface.

Figure 2:
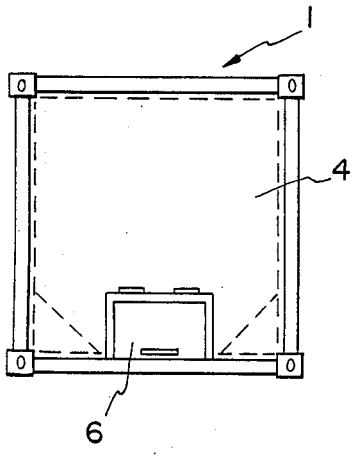
FIG. 2 is a front end view of the storage cell illustrating the exit means.
Figure 3:
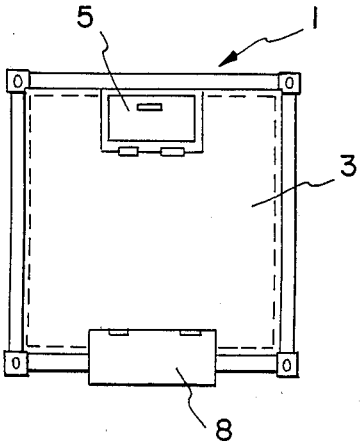
FIG. 3 is an end view on an opposite view of that shown in FIG. 2 and illustrates the loading means for loading of the individual storage cell.

FIG. 2 illustrates the exit means 6 which comprises a hinged discharge door with a handle attached thereto to facilitate opening and closing of the door. The exit door is located at the lower portion of front end 4 to allow the grain to flow therefrom by gravitational force. FIG. 3 illustrates the opposite end or back end 3 having a loading means 5 which includes a loading door hingedly connected to the retaining wall of back end 3. FIG. 3 further shows the interlocking means 8 for use in stacking of the storage cells.

Figure 4:
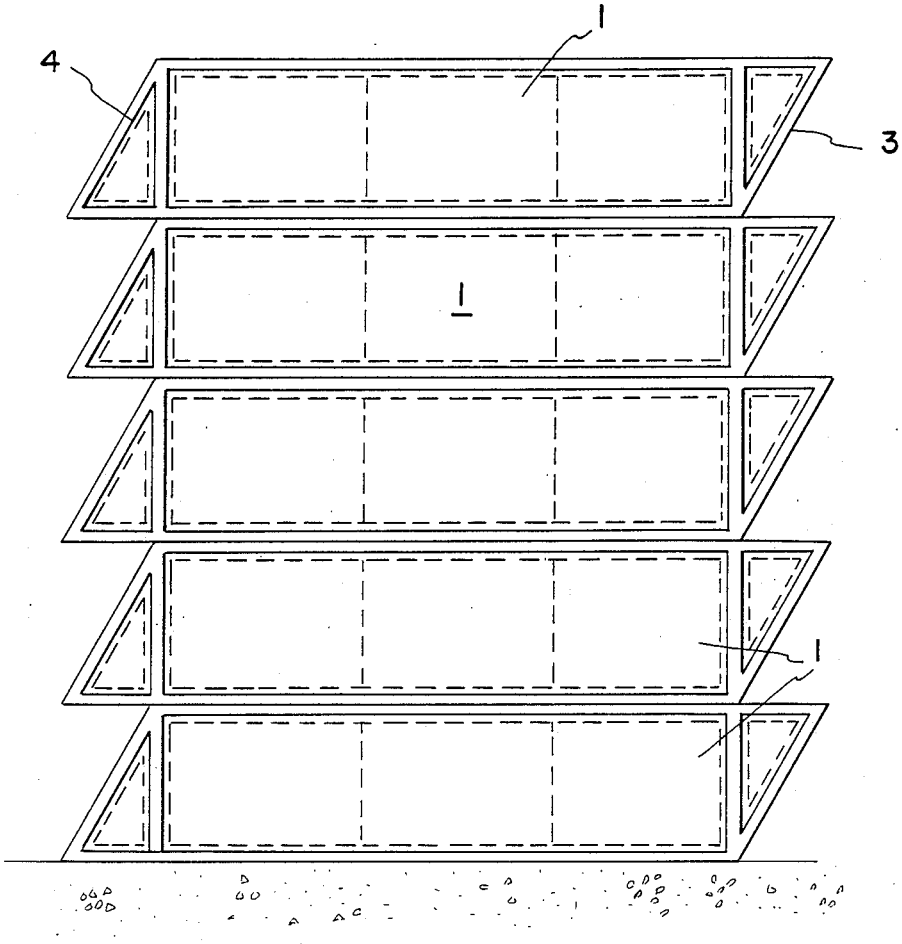
FIG. 4 is a side view of a plurality of storage cells in stacked orientation having their top and bottom walls parallel to the surface.
Figure 5:
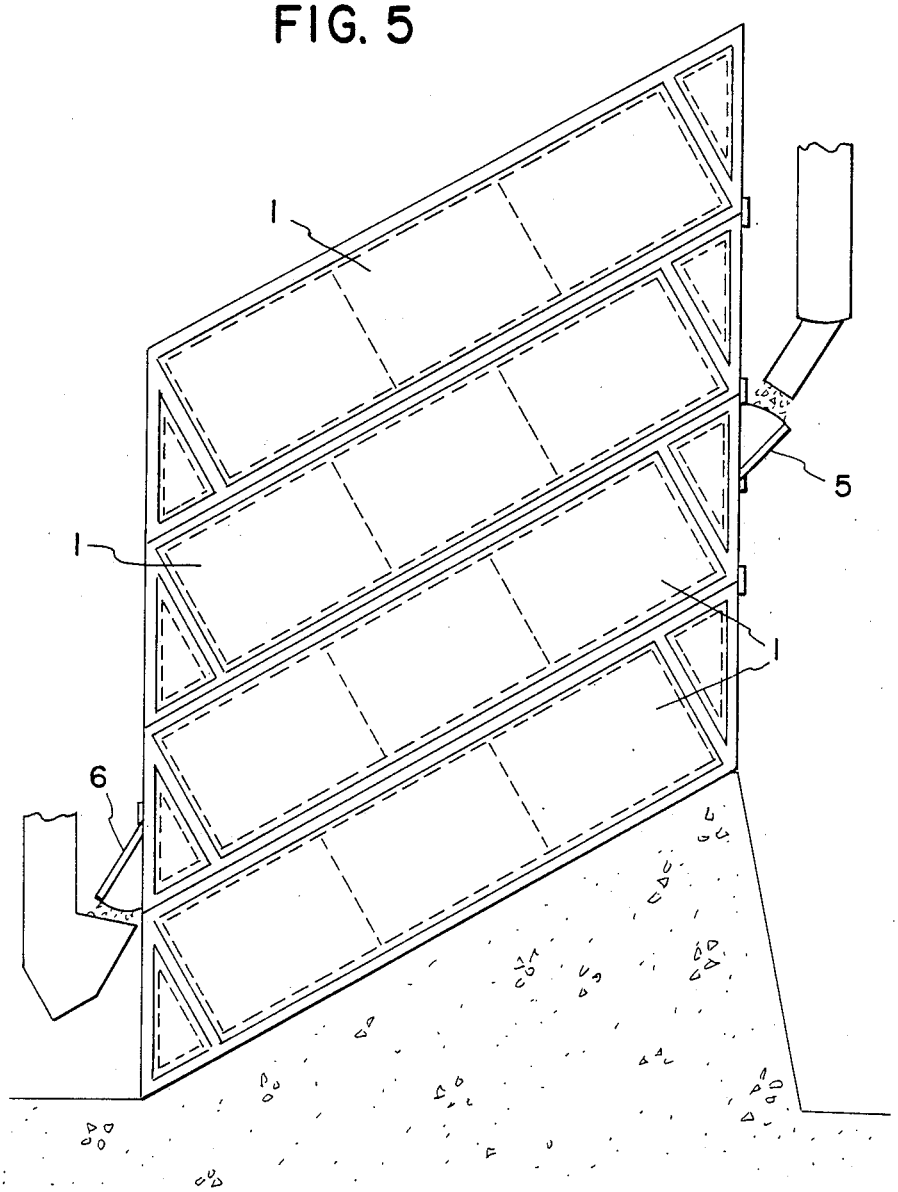
FIG. 5 is a side view illustrating the loading and discharging of an individual storage cell while in its stacked orientation at a central loading port.

Referring to FIGS. 4 and 5, the individual storage cells 1 can be stacked one upon the other for loading and discharging of the contents within their respective storage compartments. FIG. 5 illustrates the preferred method of stacking the storage cells 1 at an inclined angle of 60° from the ground level whereupon the front and back ends extend vertically and substantially perpendicular to the ground. In this manner, the grain can be loaded through the loading means 5, and due to the gravitational force and the inclined angle of the storage cells, the grain will naturally flow downwardly towards the front end allowing the storage compartment to be completely filled with whatever granulated substance being loaded at the time. If it is desired to discharge any of the contents within the storage cell, the discharge door 6 can be opened whereupon the contents within the storage cell will naturally flow out an awaiting receptacle.

Figure 6:
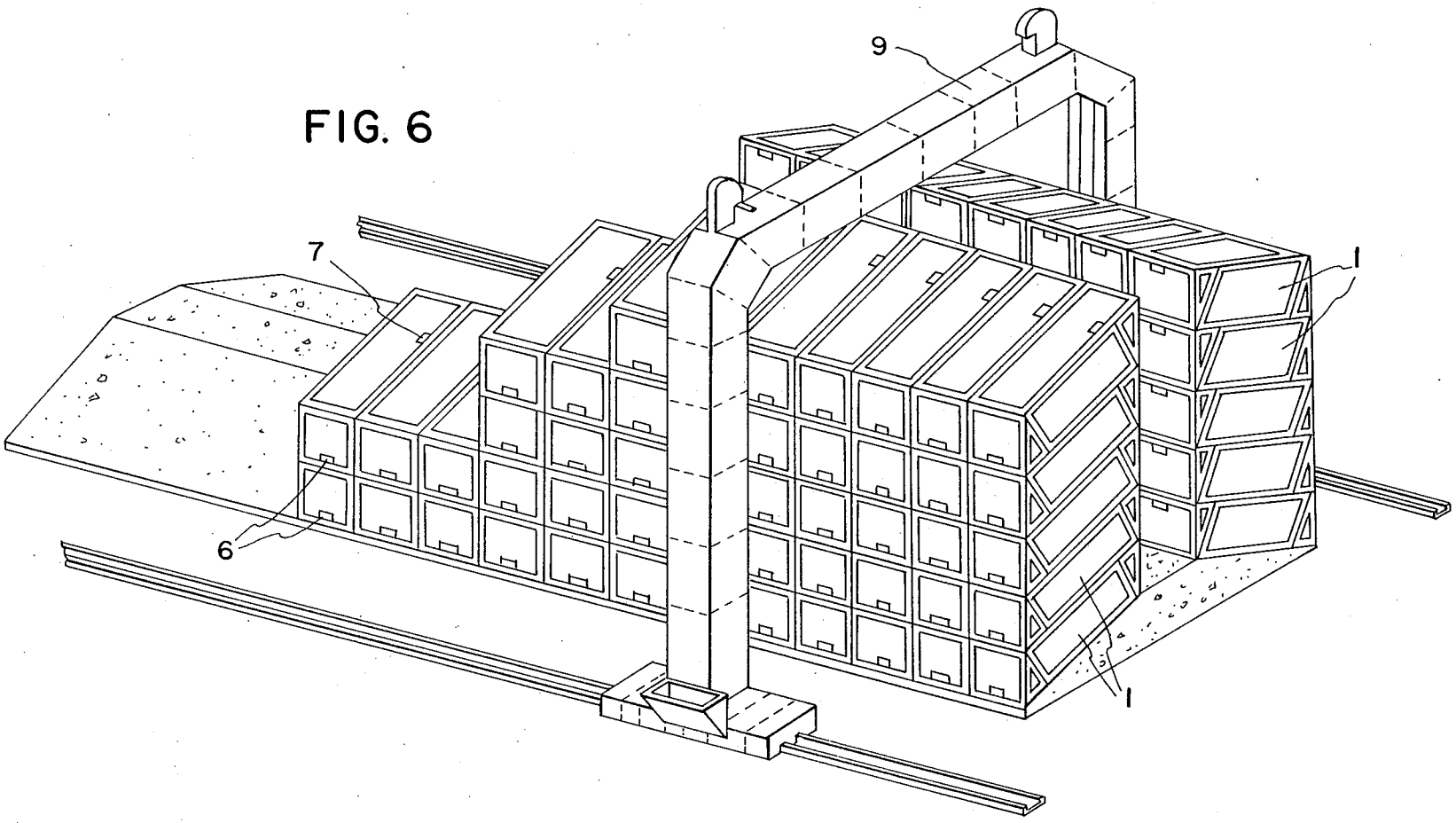
FIG. 6 is a perspective view illustrating a common loading port representing a mobile silo made up of a number of individual storage cells in stacked orientation.
Figure 7:
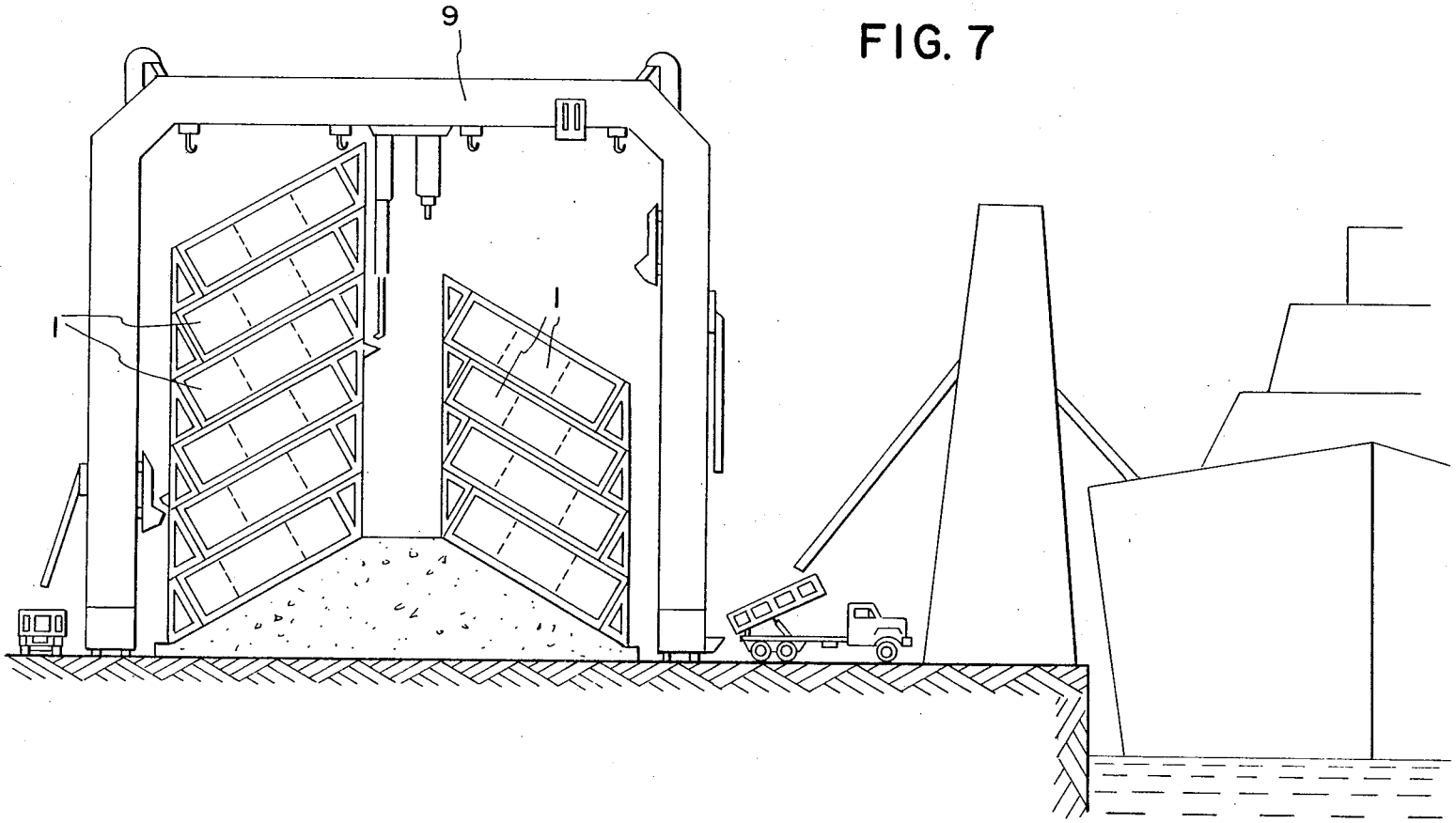
FIG. 7 is a side view of a typical maritime grain storing complex including a mobile silo facility.

Referring to FIG. 6, the mobile silo of the present invention includes a large quantity of the individual storage cells 1 stacked one upon the other forming columns along a length of an inclined floor or bed 20. The individual storage cells are loaded and unloaded from their stacked position by use of a crane structure 9 which travels along the length of the inclined floor or bed 20 and positions itself as necessary. The individual storage cells 1 can then be transferred from their stacked position and placed upon a transport vehicle for delivery to their appropriate destination.

Now that the invention has been described,

What is claimed is:

1. A mobile grain silo for the transportation and storage of grain, granulated or pelletized food and other related materials, comprising:

(a) a plurality of individual storage cells for storing and transporting a segregated load of grain, (b) a supporting frame structure formed from a plurality of stanchions and defining the outer dimensions of said individual storage cells, (c) a plurality of retaining walls fixedly secured to said frame structure and defining a storage compartment therein for retaining said grain within said individual storage cells, (d) locking means for lifting and interlocking said individual storage cells in stacked relation to one another, (e) said plurality of retaining walls including a top wall, a bottom wall, a first end wall, a second end wall, and two side walls, (f) viewing means on said top wall for inspecting said storage compartment of said storage cells, (g) loading means on said first end wall for loading said grain into said storage cells, and (h) exit means on said second end wall for discharging said grain from said storage cells.

2. An assembly as in claim 1 wherein said first end wall and said second end wall are parallel to each other.

3. An assembly as in claim 2 wherein said first end wall and said second end wall extend between said top wall and said bottom wall at an angle of 60° thereto.

4. An assembly as in claim 3 wherein said interlocking means includes metal fittings secured to said frame structure on each of said individual storage cells and, said metal fittings being adapted to interlock said storage cells to one another in a stacked array.

5. An assembly as in claim 4 wherein said viewing means includes a viewing door hingedly connected to said top wall.

6. An assembly as in claim 5 wherein said viewing door includes a handle to facilitate opening and closing thereof.

7. An assembly as in claim 6 wherein said loading means includes a loading door hingedly connected to said first end wall.

8. An assembly as in claim 7 wherein said loading door includes a handle to facilitate opening and closing thereof.

9. An assembly as in claim 8 wherein said exit means includes a discharge door hingedly connected to said second end wall.

10. An assembly as in claim 9 wherein said discharge door includes a handle to facilitate opening and closing thereof.

11. An assembly as in claim 1 wherein said frame structure includes reinforced portions defined by a thicker layer of material on designated portions of said stanchions.

12. An assembly as in claim 8 wherein said loading door is positioned on an upper portion of said end wall.

13. An assembly as in claim 10 wherein said discharge door is positioned on an lower portion of said second end wall.

14. An assembly as in claim 1 wherein said side walls are of a parallelogram shape.

15. An assembly as in claim 1 wherein said top wall is parallel to said bottom wall.

* * * * *